US008038085B2

(12) United States Patent
O'Leary

(10) Patent No.: US 8,038,085 B2
(45) Date of Patent: Oct. 18, 2011

(54) LOOSEFILL BAG DIGESTER FOR BLOWING INSULATION MACHINE

(75) Inventor: Robert J. O'Leary, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 12/706,946

(22) Filed: Feb. 17, 2010

(65) Prior Publication Data

US 2011/0198422 A1 Aug. 18, 2011

(51) Int. Cl.
*B02C 19/00* (2006.01)

(52) U.S. Cl. ..... 241/60; 241/143

(58) Field of Classification Search ..... 241/60, 241/143, 236, 605

See application file for complete search history.

(56) References Cited

U.S. PATENT DOCUMENTS

| | | | | |
|---|---|---|---|---|
| 2,869,793 | A | 1/1959 | Montgomery | |
| 2,989,252 | A | 6/1961 | Babb | |
| 3,051,398 | A | 8/1962 | Babb | |
| 3,314,732 | A | 4/1967 | Hagan | |
| 4,134,508 | A | 1/1979 | Burdett, Jr. | |
| 4,337,902 | A | 7/1982 | Markham | |
| 4,381,082 | A | 4/1983 | Elliott et al. | |
| 5,462,238 | A | 10/1995 | Smith et al. | |
| 5,639,033 | A | 6/1997 | Miller et al. | |
| 5,829,649 | A | 11/1998 | Horton | |
| 6,109,488 | A * | 8/2000 | Horton | 222/636 |
| 6,896,215 | B2 | 5/2005 | Lucas et al. | |
| 7,712,690 | B2 | 5/2010 | Johnson et al. | |
| 7,731,115 | B2 | 6/2010 | Johnson et al. | |
| 7,819,349 | B2 | 10/2010 | Johnson et al. | |
| 2006/0024458 | A1 | 2/2006 | O'Leary et al. | |
| 2007/0246581 | A1 * | 10/2007 | Matlin et al. | 241/30 |

* cited by examiner

*Primary Examiner* — Faye Francis
(74) *Attorney, Agent, or Firm* — MacMillan, Sobanski & Todd, LLC

(57) ABSTRACT

Machines for distributing loosefill insulation from a package of compressed loosefill insulation are provided. The package of compressed loosefill insulation includes a bag encapsulating a body of compressed loosefill insulation. The machine includes a chute having an inlet end and an outlet end. The inlet end of the chute is configured to receive the package of compressed loosefill insulation. A plurality of shredders is mounted at the outlet end of the chute and configured to shred and pick apart the loosefill insulation. A bag digester is configured to shred the bag into short strips of shredded bag. The short strips of shredded bag are configured to mix with the shredded loosefill insulation. A discharge mechanism is positioned downstream from the bag digester and the shredders and is configured for distributing the shredded loosefill insulation and the short strips of shredded bag into an airstream.

4 Claims, 6 Drawing Sheets

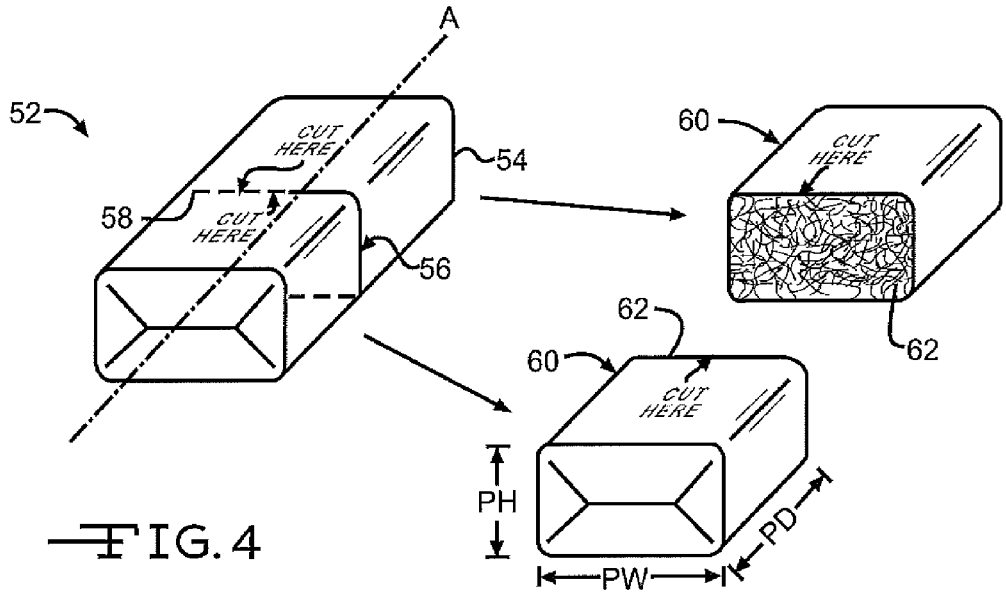
FIG. 4
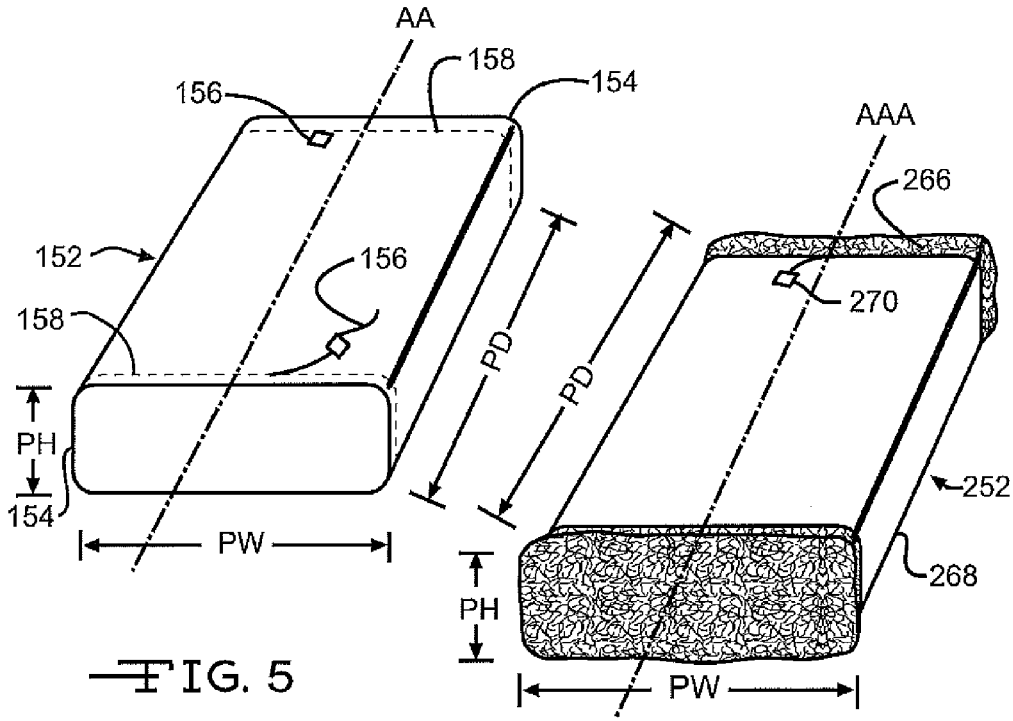
FIG. 5
FIG. 6

LOOSEFILL BAG DIGESTER FOR BLOWING INSULATION MACHINE

BACKGROUND

In the insulation of buildings, a frequently used insulation product is loosefill insulation. In contrast to the unitary or monolithic structure of insulation batts or blankets, loosefill insulation is a multiplicity of discrete, individual tufts, cubes, flakes or nodules. Loosefill insulation is usually applied to buildings by blowing the loosefill insulation into an insulation cavity, such as a wall cavity or an attic of a building. Typically loosefill insulation is made of glass fibers although other mineral fibers, organic fibers, and cellulose fibers can be used.

Loosefill insulation, also referred to as blowing wool, is typically compressed and encapsulated in a bag. The compressed loosefill insulation and the bag form a package. Packages of compressed loosefill insulation are used for transport from an insulation manufacturing site to a building that is to be insulated. The bags can be made of polypropylene or other suitable materials. During the packaging of the loosefill insulation, it is placed under compression for storage and transportation efficiencies. The compressed loosefill insulation can be packaged with a compression ratio of at least about 10:1. The distribution of loosefill insulation into an insulation cavity typically uses a blowing insulation machine that feeds the loosefill insulation pneumatically through a distribution hose. Blowing insulation machines can have a chute or hopper for containing and feeding the compressed loosefill insulation after the package is opened and the compressed loosefill insulation is allowed to expand.

It would be advantageous if the blowing insulation machines could be improved to make them more efficient.

SUMMARY

In accordance with embodiments of this invention there are provided machines for distributing loosefill insulation from a package of compressed loosefill insulation. The package of compressed loosefill insulation includes a bag encapsulating a body of compressed loosefill insulation. The machine includes a chute having an inlet end and an outlet end. The inlet end of the chute is configured to receive the package of compressed loosefill insulation. A plurality of shredders is mounted at the outlet end of the chute and configured to shred and pick apart the loosefill insulation. A bag digester is configured to shred the bag into short strips of shredded bag. The short strips of shredded bag are configured to mix with the shredded loosefill insulation. A discharge mechanism is positioned downstream from the bag digester and the shredders and configured for distributing the shredded loosefill insulation and the short strips of shredded bag into an airstream.

In accordance with embodiments of this invention there are also provided methods of distributing loosefill insulation from a package of compressed loosefill insulation. The methods include the steps of providing a package of compressed loosefill insulation, the package including a bag encapsulating a body of compressed loosefill insulation, feeding the body of compressed loosefill insulation from the package into a machine for shredding and picking apart the loosefill insulation, and feeding the bag into a bag digester configured to shred the bag into short strips of shredded bag. The short strips of shredded bag are mixed with the shredded loosefill insulation for distribution by an airstream.

In accordance with embodiments of this invention there are also provided packages of compressed loosefill insulation including a body of compressed loosefill insulation, wherein the compression of the loosefill insulation is in a radially inward direction with respect to an axis extending from one end of the body of compressed loosefill insulation to another end of the body of compressed loosefill insulation, and a bag encapsulating the body of compressed loosefill insulation, the bag having a plurality of thermally resistive portions. The bag is configured for separation into short strips which can be distributed into an airstream with finely shredded loosefill insulation.

Various objects and advantages of this invention will become apparent to those skilled in the art from the following detailed description of the preferred embodiment, when read in light of the accompanying drawings.

BRIEF DESCRIPTION OF THE DRAWINGS

FIG. 4 is a perspective view of a first embodiment of a package of compressed loosefill insulation.

FIG. 5 is a perspective view of a second embodiment of a package of compressed loosefill insulation.

FIG. 6 is a perspective view of a third embodiment of a package of compressed loosefill insulation.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, blowing insulation machines incorporating bag digesters are provided. The term "bag" as used herein, is defined to mean any enclosure used to encapsulate compressed loosefill insulation. The term "package", as used herein, is defined to mean the combination of compressed loosefill insulation encapsulated by a bag. The term "loosefill insulation", as used herein, is defined to any insulation materials configured for distribution in an airstream. The term "compressed", as used herein, is defined to mean condensing into a smaller space.

The description and figures disclose blowing insulation machines with bag digesters. Generally, the bag digesters are configured to shred the bags encapsulating the compressed loosefill insulation into short strips. The short strips of digested bag are combined with conditioned loosefill insulation for distribution by the blowing insulation machines into an airstream.

Figure 1:
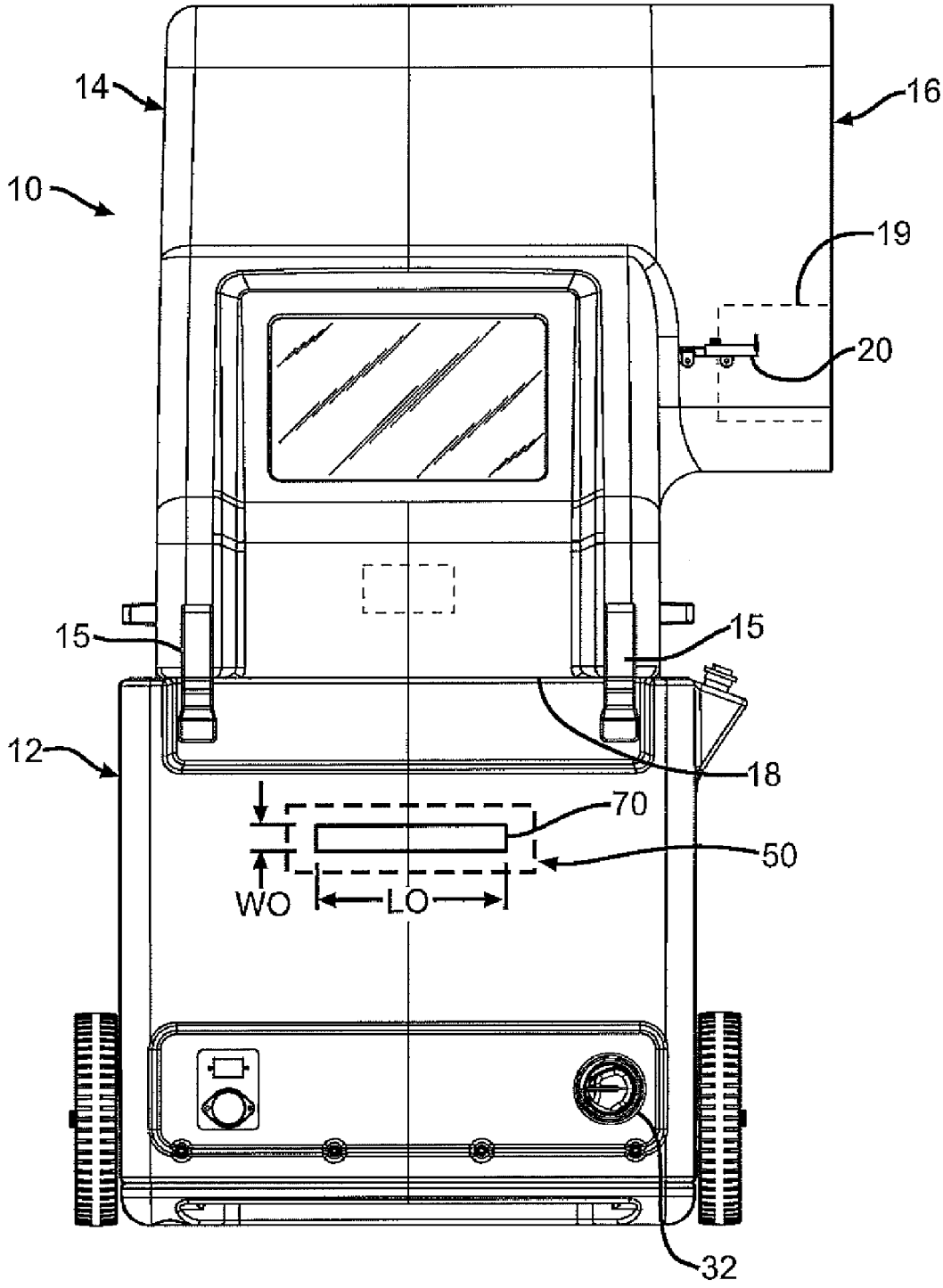
FIG. 1 is a front view, in elevation, of a blowing insulation machine.
Figure 2:
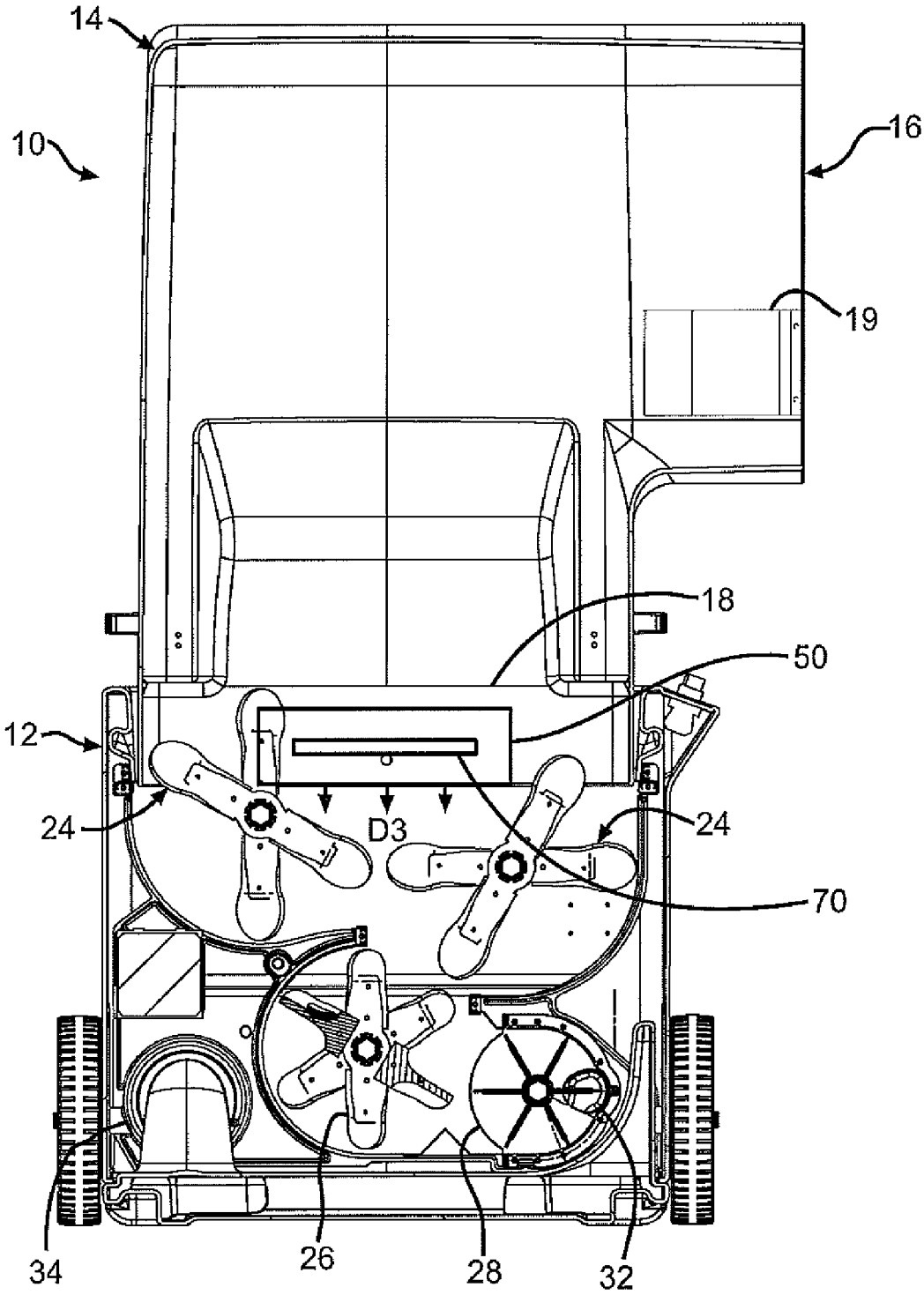
FIG. 2 is a front view, partially in cross-section, of the blowing insulation machine of FIG. 1.
Figure 3:
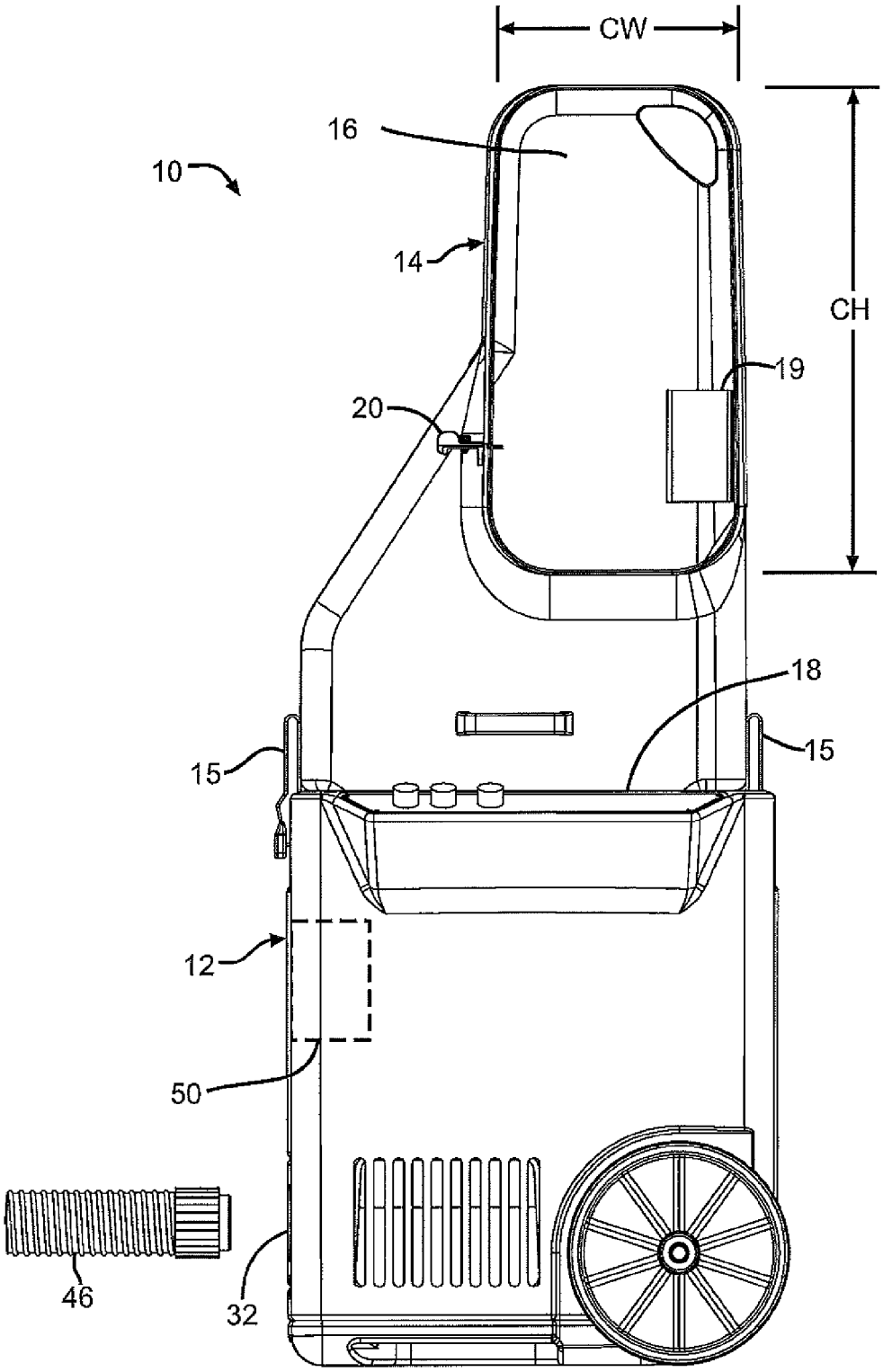
FIG. 3 is a side view, partially in cross-section, of the blowing insulation machine of FIG. 1.

One example of a blowing insulation machine configured for distributing conditioned loosefill insulation and short strips of digested bag is illustrated generally at 10 and shown in FIGS. 1-3. Referring now to FIGS. 1-3, the blowing insulation machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive a package of compressed loosefill insulation, open the bag, allow the compressed loosefill insulation to expand into the chute 14 and introduce expanded loosefill insulation to a plurality of low speed shredders 24 as shown in FIG. 2.

As further shown in FIGS. 1-3, the chute 14 can include an optional guide assembly 19 positioned at the inlet end 16 of the chute 14. The guide assembly 19 is configured to urge a package of compressed loosefill insulation against a cutting mechanism 20 as the package moves into the chute 14.

As shown in FIG. 2, the low speed shredders 24 are mounted in the lower unit 12 at the outlet end 18 of the chute 14. The low speed shredders 24 are configured to shred and pick apart the loosefill insulation as the loosefill insulation is discharged from the outlet end 18 of the chute 14 into the lower unit 12. Although the disclosed blowing insulation machine 10 is shown with the plurality of low speed shredders 24, any type of separator, such as a clump breaker, beater bar or any other mechanism that shreds and picks apart the loosefill insulation can be used.

As further shown in FIG. 2, an agitator 26 is provided for final shredding of the loosefill insulation and for preparing the loosefill insulation for distribution into an airstream. A discharge mechanism 28 is positioned downstream from the agitator 26 to distribute the shredded loosefill insulation into the airstream. The discharge mechanism 28 can be a rotary valve, or other desired devices or mechanisms including staging hoppers, metering devices, rotary feeders, sufficient to distribute the shredded loosefill insulation into an airstream. The shredded loosefill insulation is driven through the discharge mechanism 28 and through a machine outlet 32 by an airstream provided by a blower (not shown) mounted in the lower unit 12.

The shredders 24, agitator 26 and the discharge mechanism 28 are mounted for rotation. They can be driven by any suitable means, such as by an electric motor 34, or any other means sufficient to drive rotary equipment. Alternatively, each of the shredders 24, agitator 26, and discharge mechanism 28 can be provided with its own electric motor.

In general, the chute 14 guides the loosefill insulation to the low speed shredders 24 which shred and pick apart the loosefill insulation. The shredded loosefill insulation drops from the low speed shredders 24 into the agitator 26. The agitator 26 prepares the loosefill insulation for distribution into an airstream by further shredding the loosefill insulation into finely shredded loosefill insulation. The finely shredded loosefill insulation exits the agitator 26 and enters the discharge mechanism 28 for distribution into the airstream caused by the blower. The airstream, with the finely shredded loosefill insulation, exits the machine 10 at the machine outlet 32 and flows through a distribution hose 46, as shown in FIG. 3, toward the insulation cavity (not shown).

Referring again to FIGS. 1-3, the blowing insulation machine 10 includes a bag digester 50. The bag digester 50 is configured to shred the bags encapsulating the compressed loosefill insulation into short strips. The short strips of digested bag are combined with finely shredded loosefill insulation for distribution by the blowing insulation machine 10 into the airstream. In the illustrated embodiment, the bag digester 50 is positioned in the front of the lower unit 12 of the blowing insulation machine 10. However, in other embodiments, the bag digester 50 can be positioned in other desired locations, such as the non-limiting examples of the back of the lower unit 12 or in the chute 14. The bag digester 50 will be discussed in more detail below.

The embodiment of the blowing insulation machine 10 illustrated in FIGS. 1-3 is configured to receive packages of compressed loosefill insulation having different configurations. Referring now to FIGS. 4-6, various non-limiting examples of packages of compressed loosefill insulation are illustrated. In one example as illustrated in FIG. 4, a package 52 includes a bag 54 configured to encapsulate a body of compressed loosefill insulation. The package 52 includes a slit 56 oriented along a suggested cut line 58. The slit 56 extends through the body of compressed loosefill insulation and the bag 54 and partially divides the package 52. The package 52 is separated into half packages 60 by extending the slit 56 along the suggested cut line 58 by any desired means. The half packages 60 include ends 62 having exposed compressed loosefill insulation.

Referring now to FIG. 5, a second example of a package 152 of compressed loosefill insulation is illustrated. The package 152 includes tear away end portions 154. The tear away end portions 154 are configured for removal prior to insertion of the package 152 into the blowing insulation machine 10. The tear away end portions 154 can be removed by any desired method, including the non-limiting examples of a ripcord 156 and a tear away seam 158 having weakened bag material. After removal of the tear away end portions 154, the ends of the package 152 will have exposed compressed loosefill insulation. While the embodiment shown in FIG. 5 illustrates both ends of the package 152 having tear away end portions 154, it should be appreciated that in other embodiments only one end of the package 152 has a tear away end portion 154.

In another embodiment as shown in FIG. 6, a package 252 includes a body of compressed loosefill insulation 266 encapsulated in a sleeve 268. While the sleeve 268 shown in FIG. 6 is a one piece member, the sleeve 268 is defined to be any material or structure, such as bands, film or glue, sufficient to maintain the body 266 of loosefill insulation in the desired compression.

Referring again to FIG. 6, an optional gripping tab 270 is connected to the sleeve 268 and extends past the end of the sleeve 268. The gripping tab 270 is gripped by the machine user as the package 252 is fed into the chute 14 and allows the machine user to easily retain the sleeve 268 after the compressed loosefill insulation has been fed into the blowing insulation machine 10. While a single gripping tab 270 is shown in FIG. 6, it should be understood that more than one gripping tab 270 may be connected to the sleeve 268. The gripping tab 270 can be any material, such as plastic, sufficient to be gripped by the machine user and retain the sleeve 268 as the package 252 is fed into the blowing insulation machine 10.

Referring again to FIG. 3, the chute 14 has a substantially rectangular cross-sectional shape that approximates the substantially rectangular cross-sectional shapes of the half packages 60 and the packages 152 and 252 of compressed loosefill insulation shown in FIGS. 4-6. Referring now to FIGS. 4, 5 and 6, the half packages 60 and the packages 152 and 252 have a package width PW, a package depth PD and a package height PH. In the illustrated embodiment, the package width PW is approximately 19 inches, the package depth PD is approximately 19 inches and the package height PH is approximately 9 inches. However, the package width PW, package depth PD and the package height PH can be other desired dimensions. Referring again to FIG. 3, the chute 14 has a substantially rectangular cross-section shape having a chute width CW of about 9 inches and a chute height CH of about 20 inches. The substantially rectangular cross-sectional shape of the chute 14 allows the half packages 60 and the packages 152 and 252 to be easily received and fed through the chute 14.

Referring again to FIGS. 4, 5 and 6, the bags 54, 154 and the sleeve 268 are made of a polymeric material, such as the non-limiting example of polyethylene, although any type of material suitable for maintaining the loosefill insulation in the desired compression can be used. The bags 54, 154 and the sleeve 268 can provide a waterproof barrier against water, dirt and other deleterious effects. By using a polymeric material for the bags 54, 154 and the sleeve 268, the compressed loosefill insulation will be protected from the elements during transportation and storage of the package.

Optionally, the bags 54, 154 and the sleeve 268 can include thermally reflective portions or surfaces (not shown). In one embodiment, the thermally reflective portions or surfaces can be formed integral to the bags 54, 154 and the sleeve 268. Alternatively, the thermally reflective portions or surfaces can be added to the bags 54, 154 or the sleeve in any desired manner, including the non-limiting examples of printing on the bags or the sleeve by applying stickers to the bags 54, 154 or the sleeve 268. In still other embodiments, the bags 54, 154 and the sleeve 268 can be made from thermally reflective materials. The thermally reflective portions or surfaces can include any desired thermally reflective material, such as the non-limiting example of aluminum foil. The optional thermally reflective portions or surfaces will be discussed in more detail below.

While the bags 54, 154 and the sleeve 268 are illustrated as a continuous structure configured for maintaining the body of compressed loosefill insulation in the desired compression, it should be appreciated that the bags 54, 154 and the sleeve 268 can be embodied as other desired structures, including non-limiting discontinuous structures such as for example netting.

The compressed loosefill insulation encapsulated within the packages 52, 152 and 252 can be any loosefill insulation, such as a multiplicity of discrete, individual tuffs, cubes, flakes, or nodules. The loosefill insulation can be made of glass fibers or other mineral fibers, and can also be organic fibers or cellulose fibers. The loosefill insulation can have a binder material applied to it, or it can be binderless. The loosefill insulation encapsulated within the packages 52, 152 and 252 is compressed to a compression ratio of at least 10:1, which means that the unconstrained loosefill insulation, after the bags 54, 154 and sleeve 268 is opened, has a volume of 10 times that of the compressed loosefill insulation in the bags 54, 154 and sleeve 268. Other compression ratios higher or lower than 10:1 can be used. Referring now to FIG. 4, the body of compressed loosefill insulation is compressed radially inwardly with respect to an axis A extending from one end of the body of compressed loosefill insulation to the opposing end of the body of compressed loosefill insulation. Referring now to FIG. 5, the body of compressed loosefill insulation is compressed radially inwardly with respect to an axis AA. Similarly, as shown in FIG. 6, the body 266 of compressed loosefill insulation is compressed radially inwardly with respect to an axis AAA.

In general operation, packages 52, 152 and 252 of compressed loosefill insulation are provided to the machine user. The package 52 is divided into half packages 60. The machine user grips the bags 54 of the half packages 60, the bag 154 of the package 152 or the sleeve 268 of the package 252 and feeds the open ends packages 52, 152 and 252 into the chute 14 of the blowing insulation machine 10. The machine user continues gripping the bags 54, 154 and the sleeve 268 as the compressed loosefill insulation is fed into the chute 14. After the compressed loosefill insulation has been fed into the chute 14, the machine user withdraws the empty bags 54, 154 and the empty sleeve 268 from the machine 10.

As discussed above and as shown in FIGS. 1 and 2, the insulation blowing machine 10 includes a bag digester 50. Generally, the bag digester 50 is configured to shred the empty bags formerly encapsulating the compressed loosefill insulation into short strips. The term "short strips", as used herein, is defined to mean strips having a width in a range of from about 0.25 inches to about 1.0 inches and a length in a range of from about 1.0 inches to about 3.0 inches. Although in other embodiments, the strips can have a width in a range less than about 0.25 inches or more than about 1.0 inches and a length less than about 1.0 inches or more than about 3.0 inches. The short strips of digested bag combine with finely shredded loosefill insulation and are distributed by the blowing insulation machine 10.

Referring now to FIGS. 1 and 2, the bag digester 50 includes an opening 70 configured to receive the empty bags 54, 154 and the empty sleeve 268. The opening 70 has a substantially rectangular cross-section shape having a length LO and a width WO. In the illustrated embodiment, the length LO of the opening 70 is in a range of from about 6.0 inches to about 8.0 inches and the width WO of the opening 70 is in a range of from about 0.50 inches to about 2.0 inches. In other embodiments, the length LO of the opening 70 can be less than about 6.0 inches or more than about 8.0 inches and the width WO of the opening 70 can be less than about 0.50 inches or more than about 2.0 inches. In still other embodiments, the opening 70 can have other desired cross-sectional shapes, such as the non-limiting example of a circular cross-sectional shape.

Figure 7:
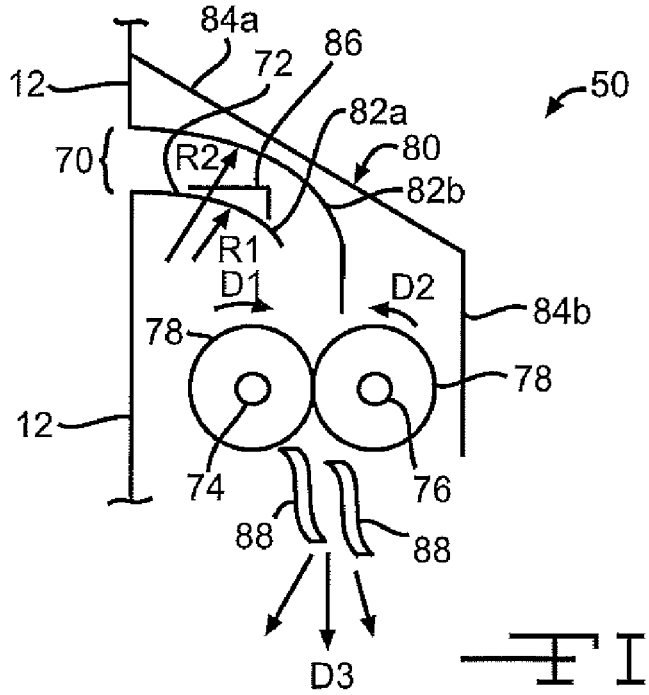
FIG. 7 is a side view, in elevation, of a first embodiment of a bag digester for the blowing insulation machine of FIG. 1.

Referring now to FIG. 7, a first embodiment of a bag digester 50 is illustrated. The bag digester 50 is positioned in the front of the lower unit 12 of the blowing insulation machine 10 The bag digester 50 includes the opening 70, a shredder chute 72, rotatable shafts 74, 76, a plurality of cutting discs 78 spaced apart along the shafts 74, 76 and a cover 80.

As shown in FIG. 7, the shredder chute 72 extends from the opening 70 of the bag digester 50 to the cutting discs 78 and is configured to guide the empty bags 54, 154 and the empty sleeve 268 from the opening 70 and introduce the empty bags 54, 154 and the empty sleeve 268 to the cutting discs 78. The chute 72 includes an inner curved segment 82*a* having a first radius R1 and an outer curved segment 82*b* having a second radius R2. The length of the curved segments, 82*a* and 82*b*, function as a safety device by preventing the machine operator from easily accessing the cutting discs 78 with fingers or hands. The first and second radii, R1 and R2, can be any desired radius sufficient to extend from the opening 70 to the cutting discs 78. The inner and outer curved segments, 82*a* and 82*b*, can be made of any material, such as the non-limiting examples of metal or reinforced plastic. Optionally, the inner and outer curved segments, 82*a* and 82*b*, can be coated with a low-friction surface to facilitate passage of the empty bags 54, 154 and the empty sleeve 268 to the cutting discs 78.

Referring again to FIG. 7, the shafts 74, 76 have a length and the cutting discs 78 are spaced apart along the length of the shafts 74, 76. The cutting discs 78 are configured to shred the empty bags 54, 154 and the empty sleeve 268 into short strips. In the illustrated embodiment, the cutting discs 78 have a circular cross-sectional shape and are made from a material sufficient to form a sharp circumferential edge, such as for example metal. In other embodiments, the cutting discs 78 can have other cross-sectional shapes, including the non-limiting examples of an ovular or square cross-sectional shape. In still other embodiments, the cutting discs 78 can include teeth or projections (not shown) configured to engage and shred the empty bags 54, 154 and the empty sleeve 268.

The cutting discs 78 are driven by the rotatable shafts 74, 76. In one embodiment, the rotatable shafts 74, 76 are driven by the motor 34 as shown in FIG. 2. In other embodiments, the rotatable shafts 74, 76 can be driven by other desired methods, such as by a separate motor (not shown).

Referring again to FIG. 7, the bag digester 50 includes the cover 80. The cover 80 is configured to prevent loosefill insulation exiting the outlet end 18 of the chute 14 from entering the bag digester 50. In the illustrated embodiment, the cover 80 includes an angled segment 84*a* and a substantially vertical segment 84*b*. The angled segment 84*a* extends from the front of the lower unit 12 as a sloped surface configured to substantially prevent accumulation of loosefill insulation. Optionally the angled segment 84*a* can have a low-friction surface or coating.

Optionally, the bag digester 50 can have a switch 86 positioned within the shredder chute 72. The switch 86 is configured to sense the presence of the empty bags 54, 154 and the empty sleeve 2 within the shredder chute 72 and subsequently activate the bag digester 50. In the illustrated embodiment, the switch 86 is a mechanical limit switch. Alternatively, the switch 86 can be other sensors, such as the non-limiting examples of optical sensors, proximity sensors and pressure sensors.

In operation, the machine user feeds the empty bags 54, 154 and the empty sleeve 268 into the opening 70 of the bag digester 50. The empty bags 54, 154 and the empty sleeve 268 traverse the shredder chute 72 and engage the switch 86. Engaging the switch 86 activates rotation of the shafts 74, 76 in the directions indicated by the arrows D1 and D2. The empty bags 54, 154 and the empty sleeve 268 engage the rotating discs 78 and are shredded thereby forming short strips 88 of shredded bag material. In one embodiment, the cutting discs 78 are configured to cut the empty bags 54, 154 and the empty sleeve 268 on a diagonal line, thereby defining the length of the short strips 88 by the circumference of the cutting discs 78. In other embodiments, a separate structure, device or mechanism (not shown) can be included in the bag digester 50 to facilitate cutting the short strips 88 to a desired length. The short strips 88 of shredded bag material exit the bag digester 50 in the direction indicated by arrow D3 and fall into the low speed shredders 24 as shown in FIG. 2. As the short strips 88 of shredded bag material fall into the low speed shredders 24, the short strips 88 mix with the loosefill insulation exiting the outlet end 18 of the chute 14. The mixture of the short strips 88 of shredded bag material and the finely shredded loosefill insulation is distributed into the airstream as described above. In one embodiment where the bag or sleeve includes thermally reflective portions or surfaces, the short strips 88 of shredded bag material can enhance the thermal resistivity of the conditioned loosefill insulation blown into a building cavity.

The embodiment of the bag digester 50 illustrated in FIG. 7 advantageously provides many benefits. However, in some instances, not all of the advantages will be realized. First, since the bag is shredded and mixed with the finely shredded insulation, the machine user is left with no waste materials. Second, by shredding the empty bags and the sleeve into short strips, the bag digester 50 substantially eliminates problems associated with strips of shredded bags wrapping around rotating shafts within the blowing insulation machine. By substantially eliminating this problem, the time and labor required to perform the unwrapping maintenance is saved. Third, since the bags and the sleeve can be engineered to include reflective surfaces, the short strips of shredded bag material can enhance the thermal resistivity of the finely shredded loosefill insulation.

While the embodiment illustrated in FIG. 7 includes cutting discs 78 positioned at the end of a shredder chute 72 having curved segments, 82*a* and 82*b*, it should be appreciated that other embodiments of the bag digester can have other orientations of the chute and the cutting discs. In the embodiment shown in FIG. 8, a bag digester 350 includes a shredder chute 372 extending from an opening 370 to a plurality of cutting discs 378. The shredding chute 372 includes segments 382*a* and 382*b* having substantially straight sides. In this embodiment, the empty bags 54, 154 and the empty sleeve 268 are fed into the opening 370 of the bag digester 350. The empty bags 54, 154 and the empty sleeve 268 traverse the shredder chute 372 and engage an optional switch 386. The optional switch 386 can be the same as, or similar to, the switch 86 discussed above and shown in FIG. 7. Alternatively, the switch 386 can be different from the switch 86. Engaging the switch 386 activates rotation of the cutting discs 378. The cutting discs 378 can be the same as, or similar to, the cutting discs 78 discussed above and shown in FIG. 7. However, the cutting discs 378 can be different from the cutting discs 78. The empty bags 54, 154 and the empty sleeve 268 engage the rotating discs 378 and are shredded thereby forming short strips 388 of shredded bag material. The short strips 388 of shredded bag material exit the cutting discs 378 in the direction indicated by arrow D4 and deflect from a cover 380. The cover 380 can be the same as, or similar to, the cover 80 discussed above and shown in FIG. 7. Alternatively, the cover 380 can be different from the cover 80. The deflected short strips 388 of shredded bag material fall in the direction of arrow D5 into the low speed shredders 24 as described above.

Figure 8:
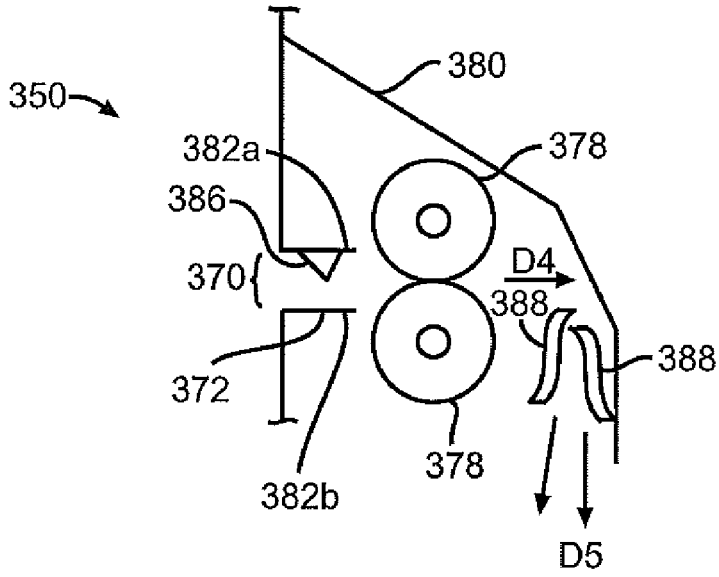
FIG. 8 is a side view, in elevation, of a second embodiment of a bag digester for the blowing insulation machine of FIG. 1.
Figure 9:
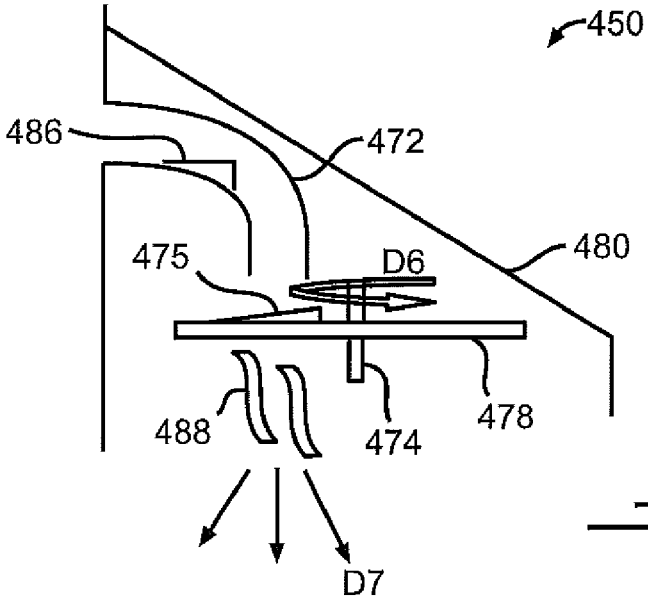
FIG. 9 is a side view, in elevation, of a third embodiment of a bag digester for the blowing insulation machine of FIG. 1.

While the embodiments discussed above and shown in FIGS. 7 and 8 illustrate cutting discs 78 and 378 configured to form the short strips 88 and 388 of shredded bag material, it should be appreciated that other structures, devices and mechanisms can be used to shred the bag material into short strips. One example of an alternate shredding mechanism is illustrated in FIG. 9. In this embodiment, a bag digester 450 includes a rotatable cutting blade 478 positioned downstream from a shredder chute 472. The shredder chute 472 can be the same as, or similar to, the shredder chute 72 discussed above and shown in FIG. 7. In other embodiments, the shredder chute 472 can be different from the shredder chute 72.

The rotatable cutting blade 478 includes a cutting edge 475 configured to shred the empty bags 54, 154 and the empty sleeve 268 into short strips as the cutting blade 478 rotates in the direction indicated by the arrow D6. While the illustrated embodiment shows a single cutting edge 475, it should be appreciated that the cutting blade 478 can include any desired number of cutting edges 475. In the illustrated embodiment, the cutting blade 478 has a circular cross-sectional shape and is made from a material sufficient to form the cutting edge 475, such as for example metal. In other embodiments, the cutting blade 478 can have other cross-sectional shapes, including the non-limiting examples of an ovular or square cross-sectional shape and can be made from other desired materials. In still other embodiments, the cutting blade 478 can include teeth or projections (not shown) configured to engage and shred the empty bags 54, 154 and the empty sleeve 268.

The cutting blade 478 is driven by the rotatable shaft 474. The rotatable shaft 474 can be driven by any desired structure, device or mechanism, such as the non-limiting example of the motor 34 as shown in FIG. 2. In other embodiments, the rotatable shaft 474 can be driven by other desired methods, such as by a separate motor (not shown).

Referring again to FIG. 9, the bag digester 450 includes a cover 480 and an optional switch 486. The cover 480 and the switch 486, can be the same as the cover 80 and the switch 86 discussed above and illustrated in FIG. 7. Alternatively, the cover 80 and the switch 86 can be different from the cover 80 and the switch 86.

Figure 10:
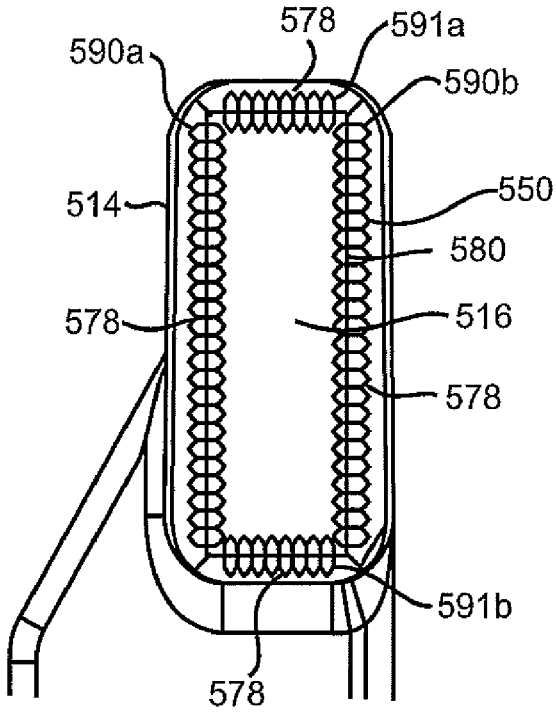
FIG. 10 is a side view, in elevation, of a fourth embodiment of a bag digester for the blowing insulation machine of FIG. 1.

In operation, the machine user feeds the empty bags 54, 154 and the empty sleeve 268 into the shredder chute 472 of the bag digester 450. The empty bags 54, 154 and the empty sleeve 268 traverse the shredder chute 472 and engage the switch 486. Engaging the switch 486 activates rotation of the shaft 474 in the direction indicated by the arrow D6. The empty bags 54, 154 and the empty sleeve 268 engage the rotating blade 478 and are shredded thereby forming short strips 488 of shredded bag material. The short strips 488 of shredded bag material exit the bag digester 450 in the direction indicated by arrow D7 and fall into the low speed shredders 24 as shown in FIG. 2. As the short strips 488 of shredded bag material fall into the low speed shredders 24, the short strips 488 mix with the loosefill insulation exiting the outlet end 18 of the chute 14 as discussed above While the embodiments of the bag digesters 50, 350 and 450 illustrated in FIGS. 7-9 are positioned in the lower unit 12, it should be appreciated that the bag digesters 50, 350 and 450 could be positioned in other locations of the blowing insulation machine 10. FIG. 10 illustrates one non-limiting embodiment of a bag digester 550 positioned in another location of the blowing insulation machine 10.

Referring now to FIG. 10, the bag digester 550 is positioned in the inlet end 516 of the chute 514. The bag digester 550 includes longitudinal columns, 590*a* and 590*b*, and lateral rows, 591*a* and 591*b*, of cutting discs 578. The cutting discs 578 can be the same as, or similar to, the cutting discs 78 discussed above and illustrated in FIG. 7. In other embodiments, the cutting discs 578 can be different from the cutting discs 78. The cutting discs 578 in the longitudinal columns, 590*a* and 590*b*, and lateral rows, 591*a* and 591*b*, are configured to engage the bags or sleeve as the packages are fed into the inlet end 516 of the chute 514. As the cutting discs 578 engage the bags or sleeve, the cutting discs 578 shred the bags and the sleeve thereby forming short strips (not shown) of shredded bag material. The formed short strips of shredded bag material travel through the chute 514 to the lower unit (not shown) and are mixed with the finely shredded loosefill insulation as discussed above. The cutting discs 578 can be driven by any desired structure, device or mechanism.

Optionally, the longitudinal columns, 590*a* and 590*b*, and lateral rows, 591*a* and 591*b*, can be covered by a cover 580 such that only a small portion of the cutting discs 578 are exposed to engage the bags or the sleeve. The optional cover can have any desired structure.

The principle and mode of operation of this blowing insulation machine have been described in its preferred embodiments. However, it should be noted that the blowing insulation machine may be practiced otherwise than as specifically illustrated and described without departing from its scope.

What is claimed is:

1. A machine for distributing loosefill insulation from a package of compressed loosefill insulation, the package of compressed loosefill insulation including a bag encapsulating a body of compressed loosefill insulation, the machine comprising:

a chute having an inlet end and an outlet end, the inlet end of the chute configured to receive the package of compressed loosefill insulation;

a plurality of shredders mounted at the outlet end of the chute and configured to shred and pick apart the loosefill insulation;

a bag digester configured to shred the bag into short strips of shredded bag, the short strips of shredded bag are configured to mix with the shredded loosefill insulation, the bag digester includes a plurality of cutting discs and a shredder chute configured to guide the bag from a bag digester opening to the plurality of cutting discs; and a discharge mechanism positioned downstream from the bag digester and the shredders and configured for distributing the shredded loosefill insulation and the short strips of shredded bag into an airstream.

2. The machine of claim 1, wherein the shredder chute includes curved segments.

3. A machine for distributing loosefill insulation from a package of compressed loosefill insulation, the package of compressed loosefill insulation including a bag encapsulating a body of compressed loosefill insulation, the machine comprising:

a chute having an inlet end and an outlet end, the inlet end of the chute configured to receive the package of compressed loosefill insulation;

a plurality of shredders mounted at the outlet end of the chute and configured to shred and pick apart the loosefill insulation;

a bag digester configured to shred the bag into short strips of shredded bag, the short strips of shredded bag are configured to mix with the shredded loosefill insulation; and a discharge mechanism positioned downstream from the bag digester and the shredders and configured for distributing the shredded loosefill insulation and the short strips of shredded bag into an airstream;

wherein the bag digester includes an opening, the opening having a cover configured to prevent loosefill insulation from entering the bag digester.

4. The machine of claim 3, wherein the cover includes an angled segment configured to prevent an accumulation of loosefill insulation.

* * * * *